US010264884B2

(12) United States Patent
DeJule

(10) Patent No.: US 10,264,884 B2
(45) **Date of Patent: *Apr. 23, 2019**

(54) SITTING APPARATUS

(71) Applicant: Aaron DeJule, River Forest, IL (US)

(72) Inventor: Aaron DeJule, River Forest, IL (US)

( * ) Notice: Subject to any disclaimer, the term of this patent is extended or adjusted under 35 U.S.C. 154(b) by 122 days.

This patent is subject to a terminal disclaimer.

(21) Appl. No.: 15/267,883

(22) Filed: Sep. 16, 2016

(65) Prior Publication Data

US 2017/0127840 A1 May 11, 2017

Related U.S. Application Data

(63) Continuation-in-part of application No. 14/462,150, filed on Aug. 18, 2014, now Pat. No. 9,655,454.

(60) Provisional application No. 62/219,741, filed on Sep. 17, 2015.

(51) Int. Cl.
*A47C 1/03* (2006.01)

(52) U.S. Cl.
CPC ..... *A47C 1/03* (2013.01); *Y10T 74/20* (2015.01)

(58) Field of Classification Search
CPC .. A47C 7/00; A47C 7/543; A47C 1/02; F16H 21/00; Y10T 74/20
USPC ..... 297/354.1, 350, 351, 440.12, 411.36, 297/411.35, 411.37, 411.38
See application file for complete search history.

(56) References Cited

U.S. PATENT DOCUMENTS 3,124,328 A * 3/1964 Kortsch ..... A47C 1/03 248/118
5,074,501 A * 12/1991 Holtta ..... A47B 1/0371 248/118.3
5,242,138 A * 9/1993 Kornberg ..... A61G 5/12 248/118
5,369,805 A * 12/1994 Bergsten ..... A47B 21/0371 297/411.23
5,407,249 A * 4/1995 Bonutti ..... A47B 21/0371 248/118
5,597,207 A * 1/1997 Bergsten ..... A47B 21/0371 297/411.23
5,651,586 A * 7/1997 Groth ..... A47C 1/03 297/411.31
5,653,499 A * 8/1997 Goodall ..... A47C 7/70 297/170
5,975,640 A * 11/1999 Chen ..... A47C 1/03 297/411.31
6,203,109 B1 * 3/2001 Bergsten ..... A47B 21/0371 297/411.35
6,290,300 B1 * 9/2001 Sutton ..... A47C 1/03 297/411.35
6,619,598 B2 * 9/2003 De Miranda ..... A61B 90/60 248/118.3

(Continued)

*Primary Examiner* — Jose V Chen
(74) *Attorney, Agent, or Firm* — Wood, Phillips, Katz, Clark & Mortimer

(57) ABSTRACT

A sitting apparatus having: a frame; an upwardly facing surface on the frame for supporting a user in a sitting position; a first arm support on the frame defining a first surface against which a user's arm can be rested with the user in the sitting position on the upwardly facing surface; and a first connecting assembly acing between the frame and first arm support. The first connecting assembly and first arm support are configured so that the first arm support surface can pivot relative to the frame around at least first and second different axes to change a relationship between the first arm support surface and the frame.

22 Claims, 7 Drawing Sheets

(56) References Cited

U.S. PATENT DOCUMENTS

| | | | | |
|---|---|---|---|---|
| 6,619,747 | B2 * | 9/2003 | Ko | A47C 7/54<br>248/118.3 |
| 6,923,505 | B2 * | 8/2005 | Siminovitch | A47C 7/54<br>248/118.1 |
| 7,452,032 | B1 * | 11/2008 | Roleder | A47C 7/54<br>297/182 |
| 9,655,454 | B2 * | 5/2017 | DeJule | A47C 7/00 |
| 2012/0032489 | A1 * | 2/2012 | Kladde | B60N 2/181<br>297/411.38 |
| 2014/0077566 | A1 * | 3/2014 | Battey | A47C 1/032<br>297/411.36 |
| 2014/0265508 | A1 * | 9/2014 | Grant | A61G 5/12<br>297/411.38 |

* cited by examiner

44'''
108
42'''
44''
42''
106

44'
GUIDE 34'
42'
BASE 36'
100
90'
98e
98d
98c
98b
98a

FRAME 12
54''
50''
34''
10''
FIXING STRUCTURE 109
44''
102
104
42''
30''
12''

SITTING APPARATUS

CROSS-REFERENCE TO RELATED APPLICATIONS

This application is a continuation-in-part of U.S. patent application Ser. No. 14/462,150, filed Aug. 18, 2014, and claims benefit of Provisional Patent Application No. 62/219,741, filed Sep. 17, 2015.

BACKGROUND OF THE INVENTION

Field of the Invention

This invention relates to a sitting apparatus and, more particularly, to a sitting apparatus that has at least one support for a user's arms with the user in a sitting position.

Background Art

A multitude of different sitting apparatus currently exists for use in the home and in businesses. The seating industry remains highly competitive, which challenges purveyors of seating products to develop functionally improved designs. Designers balance the commonly competing objectives of making an affordable chair construction and making a chair construction that is both comfortable and versatile to allow it to be used in different environments and adapt to users performing different tasks.

Arm supports/armrests are commonly incorporated into chairs to add to user comfort, avoid user fatigue, and make easier the performance of different tasks by the user from a sitting position.

Heretofore, a range of different chair constructions have been made available with arm supports/armrests with arm supporting surfaces that can be repositioned relative to the main frame upon which the chair components are built. Typically, arm support surfaces are movable vertically and laterally to accommodate different user heights and torso size and may be pivoted about vertical axes to support a user's forearms with the user's arms moved into different positions.

While these basic adjustments afford some level of utility and comfort, they are generally designed only to assist basic tasks, such as working on keyboards, etc. With the proliferation of handheld phones, tablets, computers, etc., user's sitting in chairs often hold such devices in a manner that it is impractical to use the available armrests. For example, a user may hold his/her phone with both hands immediately in front of his/her face. As this occurs, the forearms separate from the arm supports/armrests so that, at best, the user may find some support by planting the elbows on the arm supports/armrests. Extended use of the device in this manner may induce discomfort and fatigue.

The industry continues to develop designs for seating that can offer users additional comfort and more versatility at an affordable level.

SUMMARY OF THE INVENTION

In one form, the invention is directed to a sitting apparatus having: a frame; an upwardly facing surface on the frame for supporting a user in a sitting position; a first arm support on the frame defining a first surface against which a user's arm can be rested with the user in the sitting position on the upwardly facing surface; and a first connecting assembly acting between the frame and first arm support. The first connecting assembly and first arm support are configured so that the first arm support surface can pivot relative to the frame around at least first and second different axes to change a relationship between the first arm support surface and the frame.

In one form, the first and second axes intersect.

In one form, the first and second axes converge towards a shoulder region of the user with the user in the sitting position.

In one form, the sitting apparatus has laterally spaced sides. The first axis is situated so that the first arm support surface is moved laterally towards and away from a user's torso with the user in the sitting position as the first arm support surface pivots in opposite directions relative to the frame around the first axis.

In one form, the second axis is situated so that the first arm support surface is moved laterally towards and away from the user's torso with the user in the sitting position as the first arm support surface pivots in opposite directions relative to the frame around the second axis.

In one form, the first connecting assembly and first arm support are configured so that the first arm support surface is movable guidingly relative to the frame in a vertical path.

In one form, the sitting apparatus has a front and rear. The first arm support surface is configured to support a user's forearm engaged with the first arm support surface in a first manner so that a length of the user's forearm has a fore-and-aft angular orientation relative to the frame. The connecting assembly and first arm support are configured so that the fore-and-aft angular orientation of the user's forearm relative to the frame can be changed with the user's forearm engaged with the first arm support surface in the first manner.

In one form, the sitting apparatus has first and second components configured to cooperate to releasably maintain different relationships between the first arm support surface and frame.

In one form, the cooperating components have one of: a) at least one tooth and a plurality of recesses; and b) a plurality of teeth and a plurality of recesses that cooperate to releasably maintain the different relationship between the first arm support surface and frame.

In one form, the sitting apparatus has laterally spaced sides. The sitting apparatus further has a second arm support on the frame defining a second surface against which a user's arm can be rested with the user in the sitting position on the upwardly facing surface, and a second connecting assembly acting between the frame and second arm support. The second arm support and second connecting assembly have the same construction as the first arm support and first connecting assembly. The first and second arm support surfaces are on laterally opposite sides of a user's torso with the user in the sitting position.

In one form, the first connecting assembly has first and second components that are configured to move, one within the other, to thereby change the fore-and-aft angular orientation of the user's forearm relative to the frame with the user's forearm engaged with the first arm support surface in the first manner.

In one form, the first connecting assembly has first and second components that are movable relative to each other around at least one of the first axis and the second axis defined by one of: a) a pivot pin; and b) a live hinge.

In one form, the first connecting assembly has a base. The sitting apparatus is configured to guide the base vertically relative to the frame. One of the first and second axes is defined on and moves with the base.

In one form, the sitting apparatus has a front and rear. The first connecting assembly and first arm support are configured so that the first arm support surface can be shifted in a fore-and-aft direction relative to the frame without pivoting relative to the frame around the first and second axes.

In one form, the first arm support surface is configured to be shifted in a fore-and-aft direction in a translational path relative to the frame.

In one form, the first connecting assembly is configured so that the first and second axes have a fixed relationship.

In one form, the first and second components are configured so that at least one tooth and one recess are selectively engaged and disengaged by manually moving a part of the sitting assembly in a manner that changes an orientation of the first arm support surface relative to the frame.

In one form, the sitting apparatus is configured to be lifted and transported as a unit.

In one form, the sitting apparatus has: a) first and second components that are configured to be moved between; i) a disengaged relationship wherein the first arm support surface can be moved around the first axis relative to the frame within a first range; and ii) an engaged relationship wherein the first arm support surface is blocked from moving around the first axis relative to the frame through the first range; and b) third and fourth components that are configured to be moved between; i) a disengaged relationship wherein the first arm support surface can be moved around the second axis relative to the frame within a second range; and ii) an engaged relationship wherein the first arm support surface is blocked from moving relative to the second axis relative to the frame through the second range.

In one form, the first connecting assembly has an actuating component that is configured to be moved by a user relative to the frame in a predetermined path as an incident of which third and fourth components are each changed from their engaged relationship into their disengaged relationship.

DETAILED DESCRIPTION OF THE PREFERRED EMBODIMENT

Figure 1:
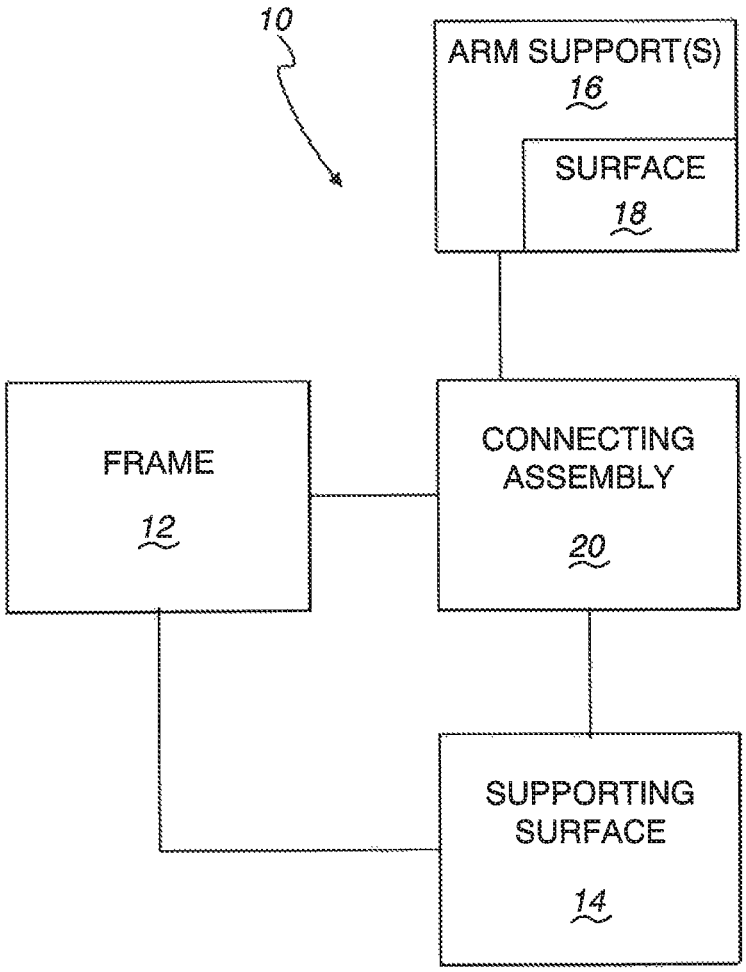
FIG. 1 is a schematic representation of a sitting apparatus, according to the present invention.

In FIG. 1, a schematic representation of a sitting apparatus, according to the present invention, is shown at 10. The sitting apparatus 10 has a frame 12 upon which components are built. Among these components is an upwardly facing surface at 14 for supporting a user in a sitting position. Any surface configuration is contemplated that will bear a user's weight.

At least one arm support 16 is provided that defines a surface 18 against which a user's arm can be rested with the user in the sitting position on the upwardly facing supporting surface 14.

A connecting assembly at 20 acts between the frame 12 and arm support 16. The connecting assembly 20 and arm support 16 are configured so that the arm support surface 18 can pivot relative to the frame 12 around at least first and second different axes to change a relationship between the arm support surface 18 and the frame 12.

The schematic showing of the components in FIG. 1 is intended to encompass specific forms of components as described hereinbelow, and virtually an unlimited number of variations of these components and how they interact. The exemplary forms of the invention should not be viewed as limiting.

In FIGS. 2-6, one exemplary form of sitting apparatus 10 is shown with a frame 12 defining a pair of laterally spaced legs 22, 24 for supporting the sitting apparatus 10 upon a subjacent surface 26.

Figure 2:
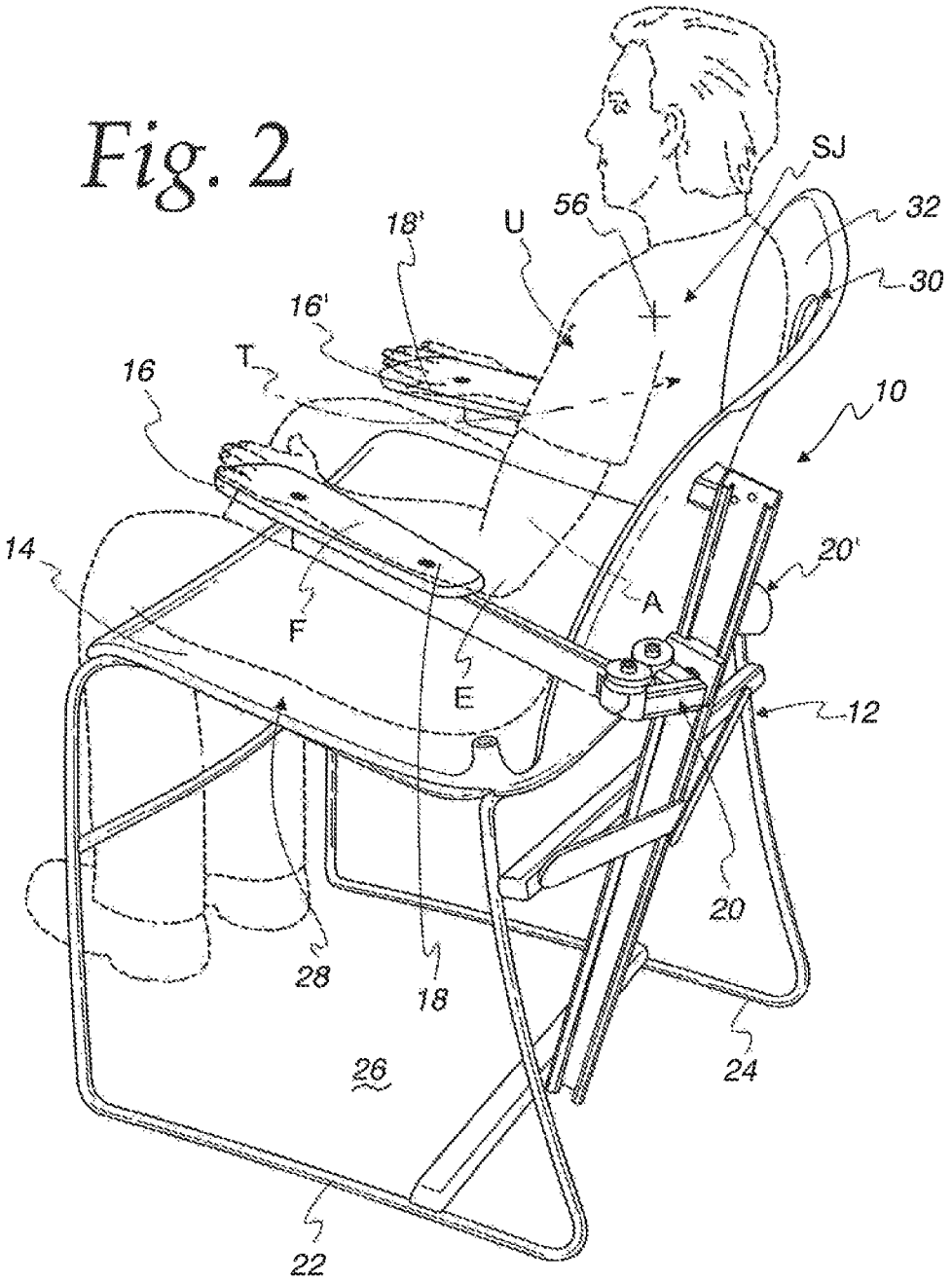
FIG. 2 is a perspective view of one specific form of sitting apparatus, within the schematic showing of FIG. 1, and with a user in a sitting position thereon.

A contoured seat 28 is situated atop the legs 22, 24 and defines the supporting surface 14 for a user U in the sitting position, as shown in FIG. 2. An upright panel 30 defines a forwardly facing back support surface 32.

Arm supports 16, 16' are provided at laterally spaced locations to define surfaces 18, 18', respectively, against which a user can rest his/her elbow E and/or forearm F.

The arm supports 16, 16' are connected to the frame 12 through the connecting assemblies 20, 20'. The arm supports 16, 16' and connecting assemblies 20, 20' have the same construction and thus description herein will be limited to the exemplary arm support 16 and its associated connecting assembly 20.

A guide 34 is provided on the frame 12 behind the panel 30. The guide 34 is in the form of an elongate rail. A base 36 on the connecting assembly 20 is movable vertically along the guide 34 in a translational path, as indicated by the double-headed arrow 38. A fastener 40 can be manually tightened to fix a desired height for the base 36 relative to the frame 12.

The connecting assembly 20 includes first and second link members 42, 44. The link member 42 has a generally forwardly opening "V" shape with spaced ends 46, 48. The end 46 is connected to the base 36 for movement relative to the base 36 and frame 12 around an axis 50. The link end 48 is connected to one end 52 of the link member 44 for pivoting movement relative thereto around an axis 54. The axes 50, 54 are fixed in relationship to each other and converge at or in the vicinity of the user's shoulder joint SJ on the respective side of the sitting apparatus 10, as indicated at the location 56. Precise intersection of the axes 50, 54 is not required so long as they converge generally towards the shoulder region. It is significant that the axes 50, 54 are not parallel. This arrangement produces a cantilever mount for the link member 44 upon which the arm support 16 is mounted.

With this described arrangement, the axis 54 is situated so that as the link member 44 pivots in opposite directions around the axis 54 relative to the link member 42 and the frame 12, as indicated by the double-headed arrow 58, the arm support surface 18 moves laterally towards and away from the sitting user's torso T. As depicted, the axis 54 is slightly inclined laterally inwardly to project at or adjacent to the sitting user's shoulder joint SJ—in this case, the left shoulder joint, as indicated at 56. With the arm support surface 18 having a flat construction, the plane thereof is slightly inclined from horizontal, although this is not a requirement. To extend to the joint location at 56, the axis 54 may be inclined slightly forwardly, or otherwise, depending upon where the link end 52 is located in the particular design. Thus, an angular relationship between the arm support surface 18 and a horizontal reference plane can be changed as movement around the axes 50, 54 is effected.

The link member 42 pivots relative to the base 36 and frame 12 about the axis 50 to cause another dimension of movement of the arm support surface 18 relative to the frame 12.

The significance of the intersection of the axes 50, 54 with the shoulder joint location 56 is that with the user's forearm F placed against the arm support surface 18 as shown in FIG. 2, the natural repositioning of the user's arm A will be closely followed by the path that the arm support surface 18 is trained to travel in by reason of the construction of the connecting assembly 20.

Figure 3:
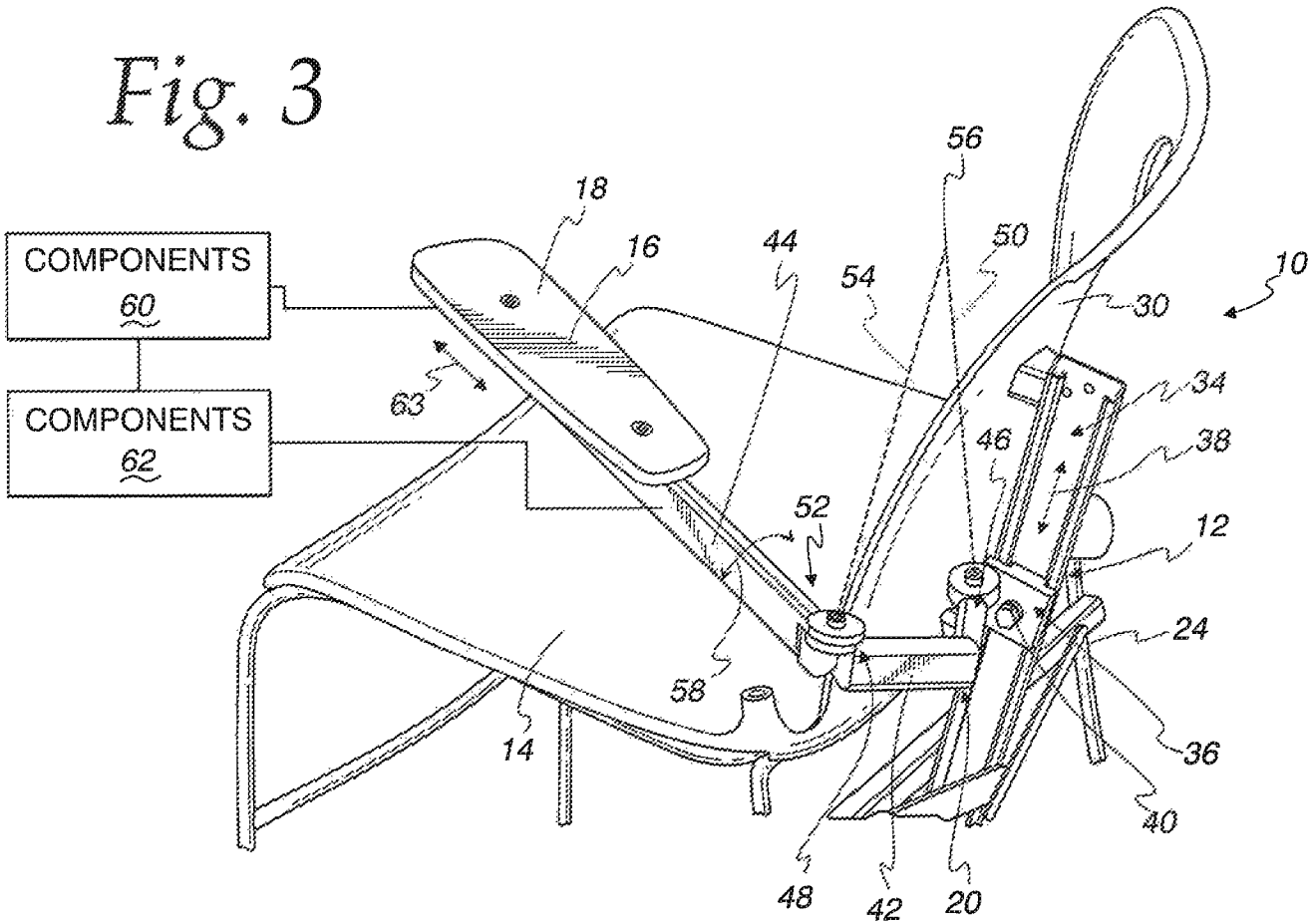
FIG. 3 is an enlarged view of a portion of the sitting apparatus as shown in FIG. 2 with only a single arm support.

As a further user accommodation, as shown in FIG. 3, the arm support 16 may be mounted to the link member 44 through cooperating component 60, 62, respectively provided at least one each on the arm support 16 and link member 44. The components 60, 62 might be, for example, a rail and slot arrangement. The schematic depiction is intended to encompass virtually any structure that allows guided fore-and-aft movement of the arm support 16 relative to the link member 44 as indicated by the double-headed arrow 63.

In summary, the arm support surface 18 moves laterally towards and away from the sitting user's torso T in a first path as the arm support surface 18 pivots with the link member 42 around the axis 50. The arm support surface 18 moves laterally towards and away from the sitting user's torso T in a different path as the arm support surface 18 moves with the link member 44 around the axis 54. The combination of these movements, by reason of the angular orientation of the axes 50, 54, allows the user to cause the arm support surface 18 to follow the user's natural arm movement through a substantial range thereof. The additional fore-and-aft movement allowed for the surface 18, together with the vertical adjustment capability, allow further adaptability to user movement.

While not required, typically the user's forearm F will be engaged with the arm support surface 16 in a first manner, as shown in FIG. 2, so that the length of the user's forearm has a fore-and-aft orientation relative to the frame 12. With the described construction, the angular orientation of the user's forearm relative to the frame 12 can be changed with the user's forearm remaining engaged with the arm support surface 16.

The connection between the link members 42, 44 and the connection between the link member end 46 and base 36 may be the same to allow relative pivoting movement. Relative movement between the link members 42, 44 and base 36 about the axes 50, 54 can be selectively fixed at connections therebetween. Details of an exemplary connection between the link members 42, 44 will be described with respect to FIGS. 4-6.

Components 64, 66 are respectively provided on the link member 44 and the link member 42. The components 64, 66 may be integrally formed with their respective link members 42, 44 or fixedly attached thereto. The components 64, 66 have surfaces 68, 70, respectively, that face each other with the link members 42, 44 connected. A post 74 extends through openings 76, 78 in the components 64, 66, respectively, and is anchored in the link member 44. The post 72 guides relative movement between the components 64, 66 around the axis 54. The link members 44, 42, to which the link members 64, 66 are fixed, thus move relative to each other around the axis 54, as described above.

The component 64 has a series of axially projecting teeth 80 at circumferentially spaced locations. The teeth 80 are engageable with complementary recesses 82 spaced circumferentially around the axis 54 of the component 66 with the components 64, 66 in different angular relationships around the axis 54.

Figures 4, 5, 6:
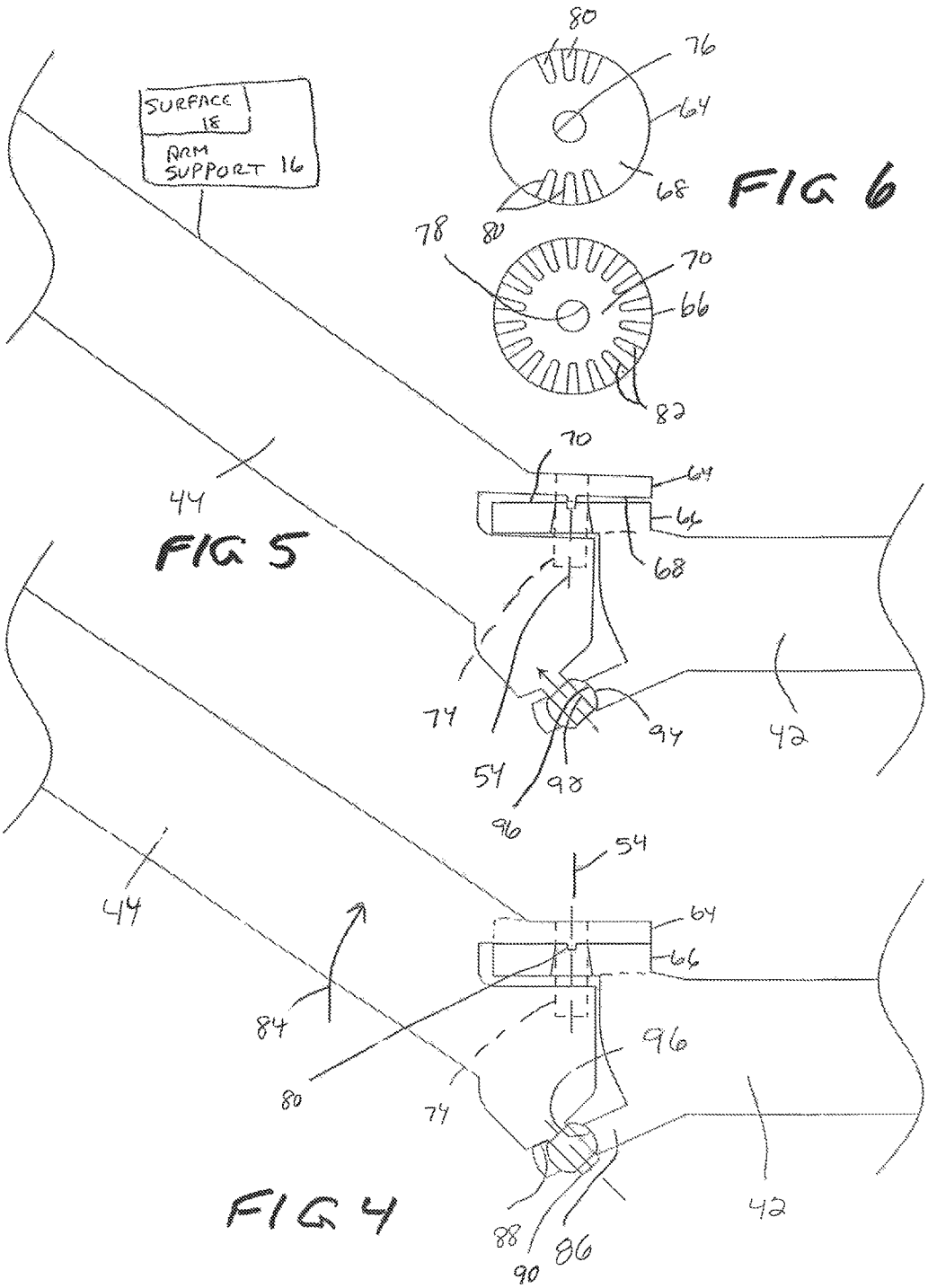
FIG. 4 is an enlarged, fragmentary, elevation view of cooperating link members that are part of a connecting assembly between a frame and arm supports on the sitting apparatus in FIGS. 2 and 3 and with the link members in a fixed state.
FIG. 5 is a view as in FIG. 4 wherein the link members are in a state wherein they are allowed to turn relative to each other around an axis.
FIG. 6 is an enlarged, end view of cooperating components that are provided, one each, on the link members in FIGS. 4 and 5 to selectively block and allow relative movement therebetween.

The arrangement of teeth 80 and recesses 82 is such that the components 64, 66 can be moved axially away from each other to a disengaged relationship, as shown in FIG. 5, and towards each other to an engaged relationship, as shown in FIG. 4, wherein the teeth 80 mesh in the recesses 82. With the components 64, 66 disengaged, the link member 44, and thus the associated arm support surface 18, can be pivoted relative to the frame 12 around the axis 54 within a predetermined range. With the components 64, 66 in the engaged relationship of FIG. 4, the link member 44, and thus the associated arm support surface 16, is blocked from moving relative to the link member 42 and frame 12 around the axis 54. The teeth 80 and recesses 82 may be constructed so that with the components 64, 66 in the engaged relationship, no relative movement is permitted between the link members 42, 44. Otherwise, construction may be such that the range is limited from that with the components 64, 66 in the disengaged relationship. A suitable combination of teeth 80 and recesses 82 may be arrived at, potentially with only a single tooth 80.

Alternatively, friction generating components might be used to cooperate and perform the same function. Rubber pads, textured surfaces, Velcro®-type components, etc. might be used.

The components 64, 66 and post 74 are configured to allow a slight radial movement between the components 64, 66 and post 74. The link members 42, 44 are configured so that with the link members 42, 44 in the FIG. 4 state, the link member 44 can be pivoted in the direction of the arrow 84 against the post 74 to allow a slight upward, axial shifting of the link member 44 and component 64 sufficient to place the components 64, 66 in the disengaged relationship of FIG. 5. In this relationship, the link member 44 can be turned around the axis 54 relative to the link member 42 to a desired position and thereafter lowered to the FIG. 4 position.

The FIG. 4 position is maintained consistently by a cantilevered arm 86 on the link member 42 that abuts a surface 88 on the link member 44. The movement of the link member 44 relative to the link member 42 is further guided and stabilized by a post 90 projecting from the surface 88 that moves within a passage 92 on a guide part 94 that in turn moves along a guide surface 96 as the link member 44 pivots relative to the link member 42 through a discrete range. With the link member 44 changed from the FIG. 4 position into the FIG. 5 position, the post 90 shifts to withdraw slightly from the passage 92 and fully reseats once the FIG. 4 state is reset.

As noted above, the connection between the link member end 46 and base 36 may be the same as that shown in FIGS. 4-6 between the link members 42, 44.

With this arrangement, the link member 44, which cantilevers forwardly, functions as an actuating component that can be conveniently grasped at a forward region by a user to exert an upward force that repositions the link member 44 from the FIG. 4 position to the FIG. 5 position. Continued upward force application causes corresponding components at the connection between the link member end 46 and the base 36 to change from a corresponding engaged relationship into a corresponding disengaged relationship, whereupon the user can move the arm support surface 18 around the axis 50. The user thus has the option of disengaging only the components 64, 66 to allow movement of the arm support surface 18 around only the axis 54. Alternatively, the user can effect disengagement at both locations to allow movement of the arm support surface 18 about both axes 50, 54. The continued upward force application may additionally raise the base 36. The user has the additional option of manually engaging the link member 42 to effect repositioning thereof, which allows the arm support surface 18 to pivot around the axis 50 while the components 64, 66 remain in their engaged relationship.

As depicted, the sitting apparatus 10 is configured to be lifted and transported as a unit. It is also possible to incorporate the invention in a seating structure that has a fixed seating surface with respect to a subjacent surface.

In the remaining Figures, certain optional constructions are shown for the basic sitting apparatus 10.

Figures 7, 8, 9, 10:
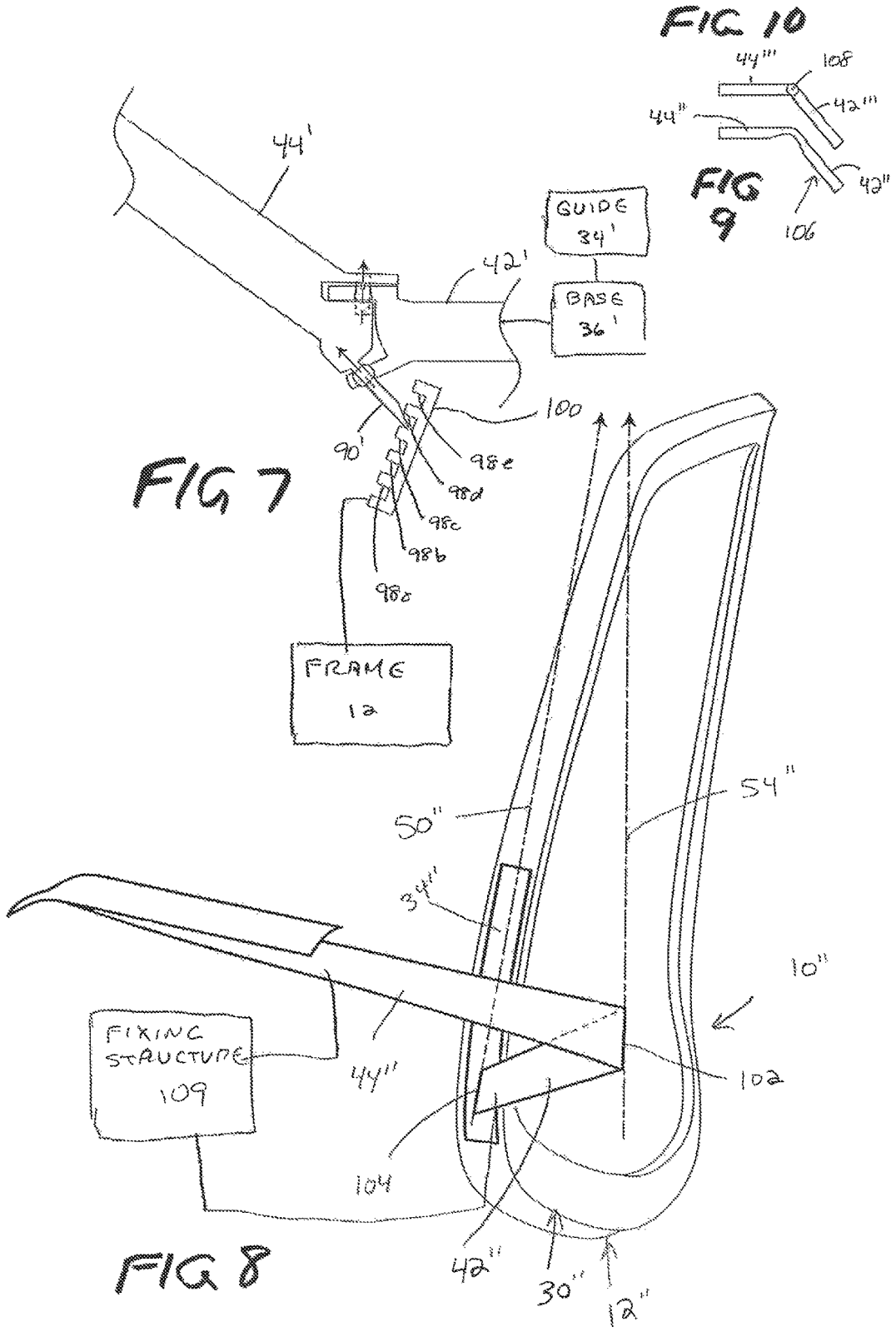
FIG. 7 is a reduced view as in FIG. 4 with one of the link members modified to fix height adjustment for an associated arm support surface.
FIG. 8 is a fragmentary, side elevation view of a modified form of sitting apparatus, according to the invention.
FIG. 9 is a fragmentary end view of a hinge connection that can be used between cooperating link members on the sitting apparatus in FIG. 8.
FIG. 10 is a view as in FIG. 9 of a modified form of hinge connection.

In FIG. 7, a variation is shown wherein a post 90', corresponding to the post 90 as shown in FIGS. 5 and 6, is extended to move into one of a series of vertically spaced receivers 98*a*, 98*b*, 98*c*, 98*d*, 98*e* in a vertical stop structure 100 on the frame 12. The link members 42', 44' can be lifted together along with a base 36' that moves in a guide 34'. The post 90' on the lowered link member 44' may be advanced into the adjacent receiver 98 to maintain the link members 42', 44' at the desired height relative to the frame 12. This avoids the need for a separate fastener, as shown at 40 in FIG. 3.

FIG. 8 shows a portion of a modified form of sitting apparatus 10". The primary difference in the FIG. 8 construction is that the link member 42" is connected to a side region of the back support panel 30", which can be considered to part of the frame 12". Additionally, the connection of the link members 42", 44" to each other and the frame 12" is shown respectively as hinge connections 102, 104. Corresponding pivot axes 50", 54" are defined. A vertical guide 34" is provided for an end of the link member 42".

Suitable hinge connections may be formed by a live hinge as shown at 106 in FIG. 9 between the link members 44", 42" and frame 12".

Alternatively, as shown in FIG. 10, hinge connections may be established by using a pin 108 between the link members 44''', 42'''.

Figure 11:
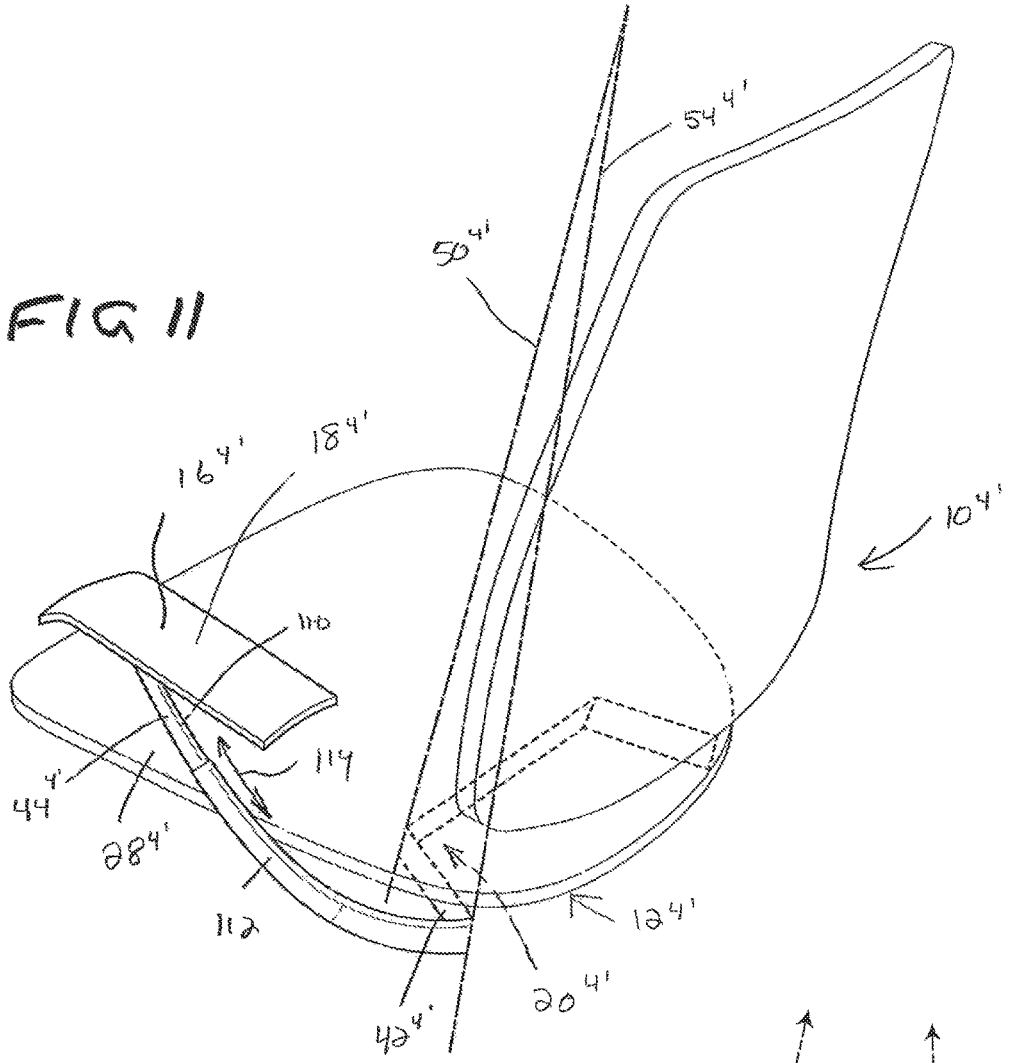
FIG. 11 is a fragmentary, perspective view of a still further modified form of sitting apparatus, according to the invention.

Another variation of the sitting apparatus is shown at $\mathbf{10}^{4'}$ in FIG. 11. The connecting assembly $\mathbf{20}^{4'}$ is shown connected to the seat $\mathbf{28}^{4'}$ which may be considered to become part of the frame $\mathbf{12}^{4'}$.

It is contemplated that the connecting assembly 20 might be connected anyplace on the remainder of the sitting apparatus, including any part of the frame 12, or component thereon, or the underlying supporting surface.

Additionally in FIG. 11, the link members $\mathbf{42}^{4'}$, $\mathbf{44}^{4'}$ have a different configuration, with the link member $\mathbf{44}^{4'}$ made up of two components 110, 112, with the component 110 connected to the arm support $\mathbf{16}^{4'}$. The components 110, 112 have conforming curvatures and are fit, one within the other so that the component 110 moves within the component 112 in a controlled curved path, as indicated by the double-headed arrow 114, to thereby change a combined length of the components 112, 114. The arm support $\mathbf{16}^{4'}$ follows this movement such that the orientation of the arm support surface $\mathbf{18}^{4'}$ is changed as it follows. This changes the fore-and-aft angular orientation of the user's forearm relative to the frame $\mathbf{12}^{4'}$ with the user's forearm engaged with the arm support surface $\mathbf{18}^{4'}$ such that the length thereof is supported on the surface $\mathbf{18}^{4'}$. The link members $\mathbf{42}^{4'}$, $\mathbf{44}^{4'}$ pivot at axes $\mathbf{50}^{4'}$, $\mathbf{54}^{4'}$.

Various combinations of the above components may be used. They may be further interconnected so that multiple dimensions of movement to effect reconfiguration are coordinated. Counterbalancing through springs, weights, etc., may facilitate user operation.

The connecting assemblies 20 may be located anywhere on a particular sitting apparatus and/or supporting structure under, or in the vicinity thereof. The components can be adapted to any particular location of the connecting assembly, be it attached below the supporting surface 14, in front or in back of the panel 30, at different lateral locations, etc.

Figure 12:
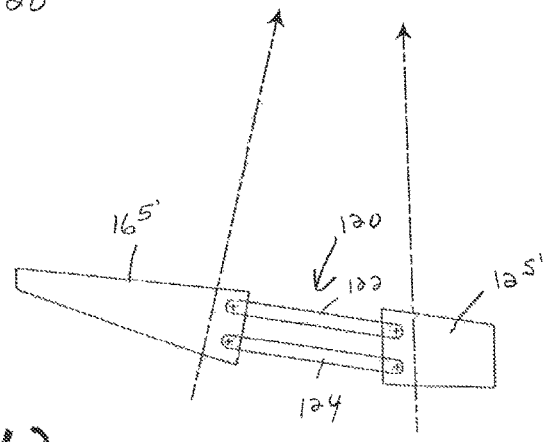
FIG. 12 is a schematic representation of a modified form of connecting assembly between a frame and arm support on a sitting apparatus.

In FIG. 12, there is a schematic representation of an arm support $\mathbf{16}^{5'}$ that is movable relative to a frame $\mathbf{12}^{5'}$ using a conventional four bar linkage at 120, with two of the links 122, 124 visible.

Figure 13:
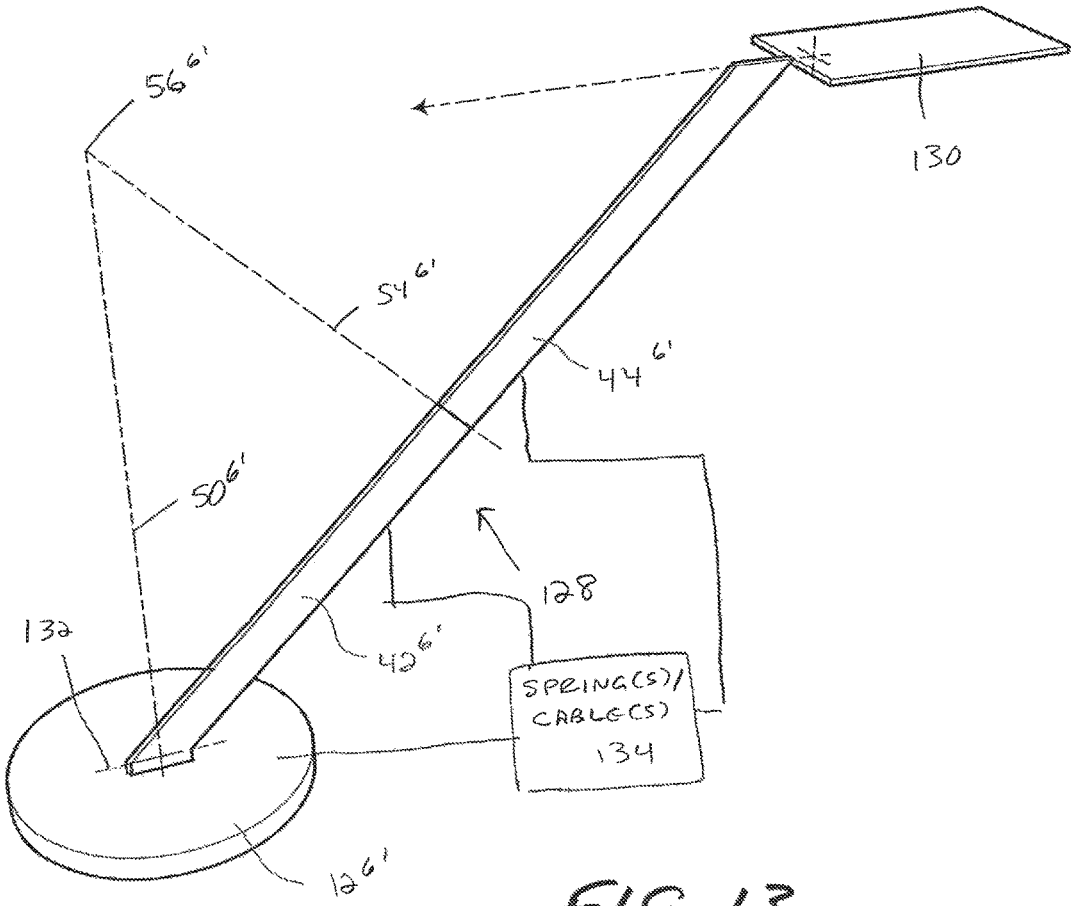
FIG. 13 is a perspective view of a lamp into which link members, as described above, can be incorporated to allow controlled repositioning of a lamp head.

The linkage member arrangement can be used in other product constructions that may benefit from a movement guided to conform to movement of a part of a user's anatomy. For example, as shown in FIG. 13, a desk lamp 128 is depicted with a base/frame $\mathbf{12}^{6'}$ with corresponding link members $\mathbf{42}^{6'}$, $\mathbf{44}^{6'}$ that cooperatively support a lamp head 130. The link members $\mathbf{42}^{6'}$, $\mathbf{44}^{6'}$ are pivotable relative to each other around the axis $\mathbf{54}^{6'}$, with the link member $\mathbf{42}^{6'}$ pivotable relative to the base/frame $\mathbf{12}^{6'}$ around the axis $\mathbf{50}^{6'}$. The axes $\mathbf{50}^{6'}$, $\mathbf{54}^{6'}$ converge at the location $\mathbf{56}^{6'}$.

The link member $\mathbf{42}^{6'}$ may also pivot relative to the base/frame $\mathbf{12}^{6'}$ around a horizontally extending axis 132, although this movement is not required. Springs/cables 134 may extend through the link members $\mathbf{42}^{6'}$, $\mathbf{44}^{6'}$ to act between the base/frame $\mathbf{12}^{6'}$ and each of the link members $\mathbf{42}^{6'}$, $\mathbf{44}^{6'}$.

The lamp head 130 may be connected to the link member $\mathbf{44}^{6'}$ in a number of different ways, as through ball joints, gimbals, universal joints for single or multiple axis movement, etc.

The foregoing disclosure of specific embodiments is intended to be illustrative of the broad concepts comprehended by the invention.

The invention claimed is:

1. A sitting apparatus comprising:

a frame;

an upwardly facing surface on the frame for supporting a user in a sitting position;

a first arm support on the frame defining a first surface against which a user's arm can be rested with the user in the sitting position on the upwardly facing surface; and a first connecting assembly acting between the frame and first arm support, the first connecting assembly and first arm support configured so that the first arm support surface can pivot relative to the frame around at least first and second different axes to change a relationship between the first arm support surface and the frame, the first connecting assembly configured so that an angular relationship between the arm support/surface and a horizontal reference plane can be changed.

2. A sitting apparatus comprising:

a frame;

an upwardly facing surface on the frame for supporting a user in a sitting position;

a first arm support on the frame defining a first surface against which a user's arm can be rested with the user in the sitting position on the upwardly facing surface; and a first connecting assembly acting between the frame and first arm support, the first connecting assembly and first arm support configured so that the first arm support surface can pivot relative to the frame around at least first and second different axes to change a relationship between the first arm support surface and the frame, wherein the first and second axes intersect.

3. A sitting apparatus comprising:

a frame;

an upwardly facing surface on the frame for supporting a user in a sitting position;

a first arm support on the frame defining a first surface against which a user's arm can be rested with the user in the sitting position on the upwardly facing surface; and a first connecting assembly acting between the frame and first arm support, the first connecting assembly and first arm support configured so that the first arm support surface can pivot relative to the frame around at least first and second different axes to change a relationship between the first arm support surface and the frame, wherein the first and second axes converge towards a shoulder region of the user with the user in the sitting position.

4. The sitting apparatus according to claim 1 wherein the sitting apparatus has laterally spaced sides and the first axis is situated so that the first arm support surface is moved laterally towards and away from a user's torso with the user in the sitting position as the first arm support surface pivots in opposite directions relative to the frame around the first axis.

5. The sitting apparatus according to claim 4 wherein the second axis is situated so that the first arm support surface is moved laterally towards and away from the user's torso with the user in the sitting position as the first arm support surface pivots in opposite directions relative to the frame around the second axis.

6. The sitting apparatus according to claim 1 wherein the first connecting assembly and first arm support are configured so that the first arm support surface is movable guidingly relative to the frame in a vertical path.

7. The sitting apparatus according to claim 6 wherein the first connecting assembly comprises a base, the sitting apparatus is configured to guide the base vertically relative to the frame and one of the first and second axes is defined on and moves with the base.

8. The sitting apparatus according to claim 1 wherein the sitting apparatus has a front and rear, the first arm support surface is configured to support a user's forearm engaged with the first arm support surface in a first manner so that a length of the user's forearm has a fore-and-aft angular orientation relative to the frame and the connecting assembly and first arm support are configured so that the fore-and-aft angular orientation of the user's forearm relative to the frame can be changed with the user's forearm engaged with the first arm support surface in the first manner.

9. The sitting apparatus according to claim 8 wherein the first connecting assembly comprises first and second components that are configured to move, one within the other, to thereby change the fore-and-aft angular orientation of the user's forearm relative to the frame with the user's forearm engaged with the first arm support surface in the first manner.

10. The sitting apparatus according to claim 1 wherein the sitting apparatus comprises first and second components configured to cooperate to releasably maintain different relationships between the first arm support surface and frame.

11. The sitting apparatus according to claim 1 wherein the sitting apparatus has laterally spaced sides and further comprises a second arm support on the frame defining a second surface against which a user's arm can be rested with the user in the sitting position on the upwardly facing surface, and a second connecting assembly acting between the frame and second arm support, the second arm support and second connecting assembly having the same construction as the first arm support and first connecting assembly, the first and second arm support surfaces on laterally opposite sides of a user's torso with the user in the sitting position.

12. The sitting apparatus according to claim 1 wherein the first connecting assembly has first and second components that are movable relative to each other around at least one of the first axis and the second axis defined by one of: a) a pivot pin; and b) a live hinge.

13. The sitting apparatus according to claim 1 wherein the sitting apparatus has a front and rear, and the first connecting assembly, first arm support, and frame are configured so that the first arm support surface can be shifted in a fore-and-aft direction relative to the frame without pivoting relative to the frame around the first and second axes.

14. The sitting apparatus according to claim 13 wherein the first arm support surface is configured to be shifted in a fore-and-aft direction in a translational path relative to the frame.

15. The sitting apparatus according to claim 1 wherein the first connecting assembly is configured so that the first and second axes have a fixed relationship.

16. The sitting apparatus according to claim 1 wherein the sitting apparatus is configured to be lifted and transported as a unit.

17. The sitting apparatus according to claim 1 wherein the sitting apparatus comprises: a) first and second components that are configured to be moved between; i) a disengaged relationship wherein the first arm support surface can be moved around the first axis relative to the frame within a first range; and ii) an engaged relationship wherein the first arm support surface is blocked from moving around the first axis relative to the frame through the first range; and b) third and fourth components that are configured to be moved between;

i) a disengaged relationship wherein the first arm support surface can be moved around the second axis relative to the frame within a second range; and ii) an engaged relationship wherein the first arm support surface is blocked from moving relative to the second axis relative to the frame through the second range.

18. The sitting apparatus according to claim 17 wherein the first connecting assembly comprises an actuating component that is configured to be moved by a user relative to the frame in a predetermined path as an incident of which the third and fourth components are each changed from their engaged relationship into their disengaged relationship.

19. A sitting apparatus comprising:

a frame;

an upwardly facing surface on the frame for supporting a user in a sitting position;

a first arm support on the frame defining a first surface against which a user's arm can be rested with the user in the sitting position on the upwardly facing surface; and a first connecting assembly acting between the frame and first arm support, the first connecting assembly and first arm support configured so that the first arm support surface can pivot relative to the frame around at least first and second different axes to change a relationship between the first arm support surface and the frame, wherein the sitting apparatus comprises first and second components configured to cooperate to releasably maintain different relationships between the first arm support surface and frame, wherein the first and second components have one of: a) at least one tooth and a plurality of recesses; and b) a plurality of teeth and a plurality of recesses that cooperate to releasably maintain the different relationship between the first arm support surface and frame, wherein in each of a) and b) at least one of the teeth being movable into and out of one of the recesses, the at least one of the teeth when in the at least one of the recesses blocking relative movement between the first and second components.

20. The sitting apparatus according to claim 19 wherein the first and second components are configured so that at least one tooth and one recess are selectively engaged and disengaged by manually moving a part of the sitting assembly in a manner that changes an orientation of the first arm support surface relative to the frame.

21. A sitting apparatus comprising:

a frame;

an upwardly facing surface on the frame for supporting a user in a sitting position;

a first arm support on the frame defining a first surface against which a user's arm can be rested with the user in the sitting position on the upwardly facing surface; and a first connecting assembly acting between the frame and first arm support, the first connecting assembly and first arm support configured so that the first arm support surface can pivot relative to the frame around at least first and second different axes to change a relationship between the first arm support surface and the frame, wherein the sitting apparatus has a front and rear, the first arm support surface is configured to support a user's forearm engaged with the first arm support surface in a first manner so that a length of the user's forearm has a fore-and-aft angular orientation relative to the frame and the connecting assembly and first arm support are configured so that the fore-and-aft angular orientation of the user's forearm relative to the frame can be changed with the user's forearm engaged with the first arm support surface in the first manner, wherein the first connecting assembly comprises first and second components that are configured to move, one within the other, to thereby change a combined length thereof and as an incident thereof the fore-and-aft angular orientation of the user's forearm relative to the frame with the user's forearm engaged with the first arm support surface in the first manner.

22. A sitting apparatus comprising:

a frame;

an upwardly facing surface on the frame for supporting a user in a sitting position;

a first arm support on the frame defining a first surface against which a user's arm can be rested with the user in the sitting position on the upwardly facing surface; and a first connecting assembly acting between the frame and first arm support, the first connecting assembly and first arm support configured so that the first arm support surface can pivot relative to the frame around at least first and second different axes to change a relationship between the first arm support surface and the frame, wherein the first connecting assembly and first arm support are configured so that the first arm support surface is movable guidingly relative to the frame in a vertical path, wherein the first connecting assembly comprises a base, wherein the sitting apparatus is configured to guide the base in a vertical translational path relative to the frame and one of the first and second axes is defined on and moves with the base.

* * * * *